United States Patent [19]

Chang

[11] Patent Number: 5,068,932

[45] Date of Patent: Dec. 3, 1991

[54] BABY CRIB WITH SLIDABLY LOCKABLE FENCE MEMBER

[76] Inventor: Jack Chang, No. 179, Pu Tzepu, Wanchas Tsuen, Chu-Chee Hsiang, Chiavi Hsien, Taiwan

[21] Appl. No.: 525,784

[22] Filed: May 18, 1990

[51] Int. Cl.[5] ..... A47D 7/02

[52] U.S. Cl. ..... 5/100; 292/42; 292/175

[58] Field of Search ..... 5/93.1, 100, 428; 292/32, 42, 175, 163

[56] References Cited

U.S. PATENT DOCUMENTS

| | | | |
|---|---|---|---|
| 1,242,509 | 10/1917 | Zatkin | 5/100 |
| 2,294,708 | 9/1942 | Barnett | 292/42 |
| 3,896,514 | 7/1975 | Feldstein | 5/100 |
| 4,226,452 | 10/1980 | Hoffman et al. | 5/100 |
| 4,530,528 | 7/1985 | Shamie | 5/100 |
| 4,703,524 | 11/1987 | Brjnner et al. | 5/100 |
| 4,825,482 | 5/1989 | Paris | 5/100 |

FOREIGN PATENT DOCUMENTS

| | | | |
|---|---|---|---|
| 317674 | 8/1929 | United Kingdom | 292/42 |

*Primary Examiner*—Alexander Grosz

*Attorney, Agent, or Firm*—Townsend and Townsend

[57] ABSTRACT

A baby crib includes a frame body having a pair of upright support posts, a fence member extending between the upright support posts and having a hollow frame with two ends, and a pair of mounting pieces mounted to the upright support posts so as to connect the fence member to the upright support posts. Each of the mounting pieces has a flat plate member formed with a plurality of spaced engaging slots and a pair of first slide rails. Each of a pair of slide bodies has a slide portion with a through hole to be selectively aligned with one of the engaging slots, and a pair of second slide rails slidably engaging the first slide rails. Each of the slide bodies includes a housing portion that projects from the slide portion into one of the two ends of the hollow frame. A pair of engaging members is movably mounted inside the housing portion of the slide bodies. Each of the engaging members has a first end moved through the through hole of the slide portion of one of the slide bodies between an engaging position, in which the first end engages one of said engaging slots, and a releasing position. Each of the engaging members further includes a laterally projecting handle portion that extends out of the hollow frame through the housing portion. A pair of biasing means is mounted in the housing portion of the slide bodies and urges the first end of the engaging member into the engaging position. The height of the fence member relative to the upright support posts can be adjusted by operating the handle portion of each of the engaging members to change the position of the engaging members relative to the mounting pieces.

2 Claims, 5 Drawing Sheets

BABY CRIB WITH SLIDABLY LOCKABLE FENCE MEMBER

BACKGROUND OF THE INVENTION

The invention relates to a baby crib, more particularly to a baby crib with a height adjustable fence.

Baby cribs with height adjustable fences, an example of which is shown in FIG. 1, are known in the art. A fixed fence member A is mounted to a pair of upright support posts B of the baby crib. A pair of vertical rods A3 secures an upper frame pole A1 of the fixed fence member A to a base member A2 of the baby crib. An adjustable fence member D has an upper and a lower frame pole D1 and D2. The lower frame pole D2 is joined to the upper frame pole A1 by hinges E. Vertical rods D3 connect the upper frame pole D1 to the lower frame pole D2. Locking means (not shown in the Figure) maintain the adjustable fence member D in an upright position. The adjustable fence member D is placed in an upright position to prevent the baby from crawling out of the crib. The adjustable fence member D can be folded to reduce the height of the fence, thus making it easier to put in or to take the baby away from the crib.

The disadvantages of the above describe baby crib are as follows:

1. The fixed fence member A and the adjustable fence member D are connected by means of hinges E. Since the baby crib is subjected to a lot of movement by the activity of the baby, the connection between the fence members A and D tends to become loose after a short period of time, thereby shortening the usable life of the fence.

2. The adjustable fence member D is rotated 180 degrees when moving the adjustable fence member D from an upright position to a folded position or vice-versa. This arc necessitates a relatively wide operating space for the adjustable fence member D.

3. The fence may be adjusted to only two possible heights.

SUMMARY OF THE INVENTION

Therefore, a main object of this invention is to provide a baby crib having a height adjustable fence which is easy to install, convenient to use, and which requires little operating space.

A second object of this invention is to provide a baby crib which has a height adjustable fence that can be adjusted to more than two height levels.

Accordingly, the preferred embodiment of a baby crib according to this invention comprises a frame body having a pair of upright support posts, a fence member extending between the upright support posts and having a hollow frame with two ends, and a pair of mounting pieces mounted to the upright support posts with which to connect the fence member to the upright support posts. Each of the mounting pieces has a flat plate member formed with a plurality of spaced engaging slots and a pair of first slide rails. A pair of slide bodies is attached to the two ends of the hollow frame. Each of the slide bodies has a portion slidably abutting one of the mounting pieces. The slide portion of each of the slide bodies has a through hole to be selectively aligned with one of the engaging slots, and a pair of second slide rails slidably engaging with the first slide rails. Each of the slide bodies includes a housing portion that projects from the slide portion into one of the two ends of the hollow frame. A cover piece, which is formed with a guide hole, is detachably mounted to the housing portion opposite the slide portion.

A pair of engaging members are movably mounted inside the housing portion of the slide bodies. Each of the engaging members has a first end disposed to move through the through hole of the slide portion of one of the slide bodies, between an engaging position, in which the first end engages one of said engaging slots, and a releasing position. Each of the engaging members further includes a laterally projecting handle portion that extends out of the hollow frame through the housing portion. Each of the engaging members has a second end opposite the first end that extends through the guide hole.

A pair of biasing means are mounted in the housing portion of the slide bodies and urges the first end of the engaging member into the engaging position. The height of the fence member relative to the upright support posts can be adjusted by operating the handle portion of each of the engaging members to change the position of the engaging members relative to the mounting pieces.

BRIEF DESCRIPTION OF THE DRAWINGS

Other features and advantages of this invention will become apparent in the following detailed description of the preferred embodiment with reference to the accompanying drawings, in which.

DETAILED DESCRIPTION OF THE PREFERRED EMBODIMENT

Figure 3:
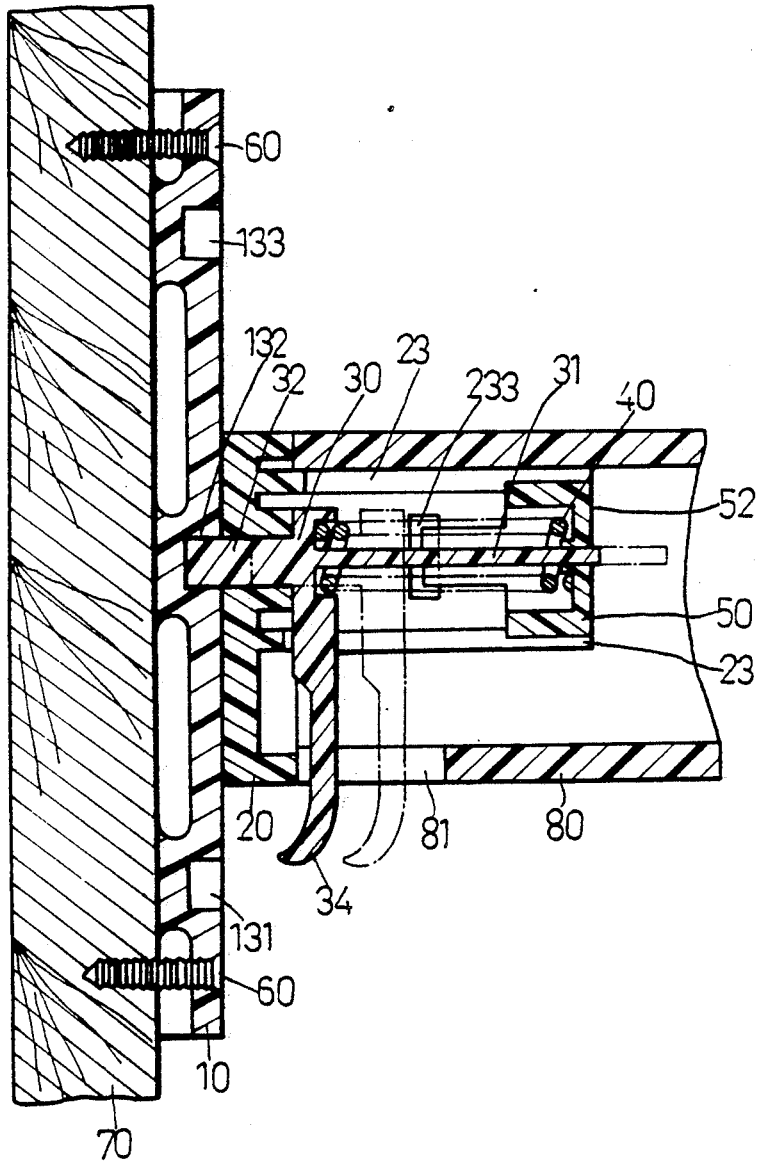
FIG. 3 is a sectional view of the adjusting means shown in FIG. 2 when assembled.
Figure 4:
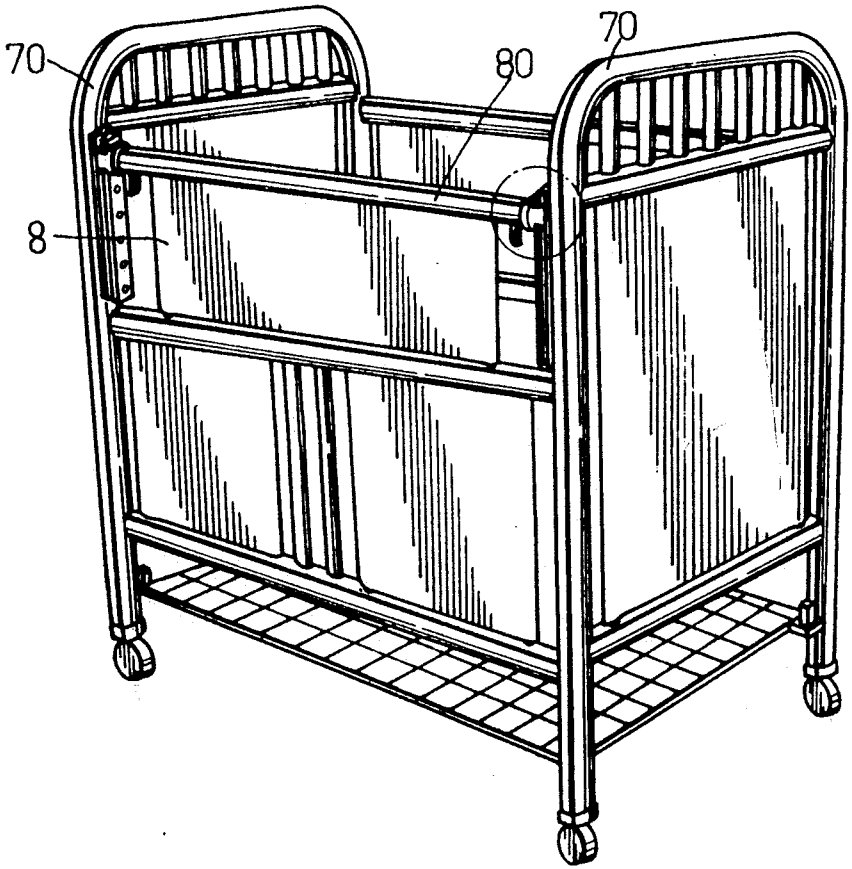
FIG. 4 is an illustration of the preferred embodiment of a baby crib of this invention.
Figure 5:
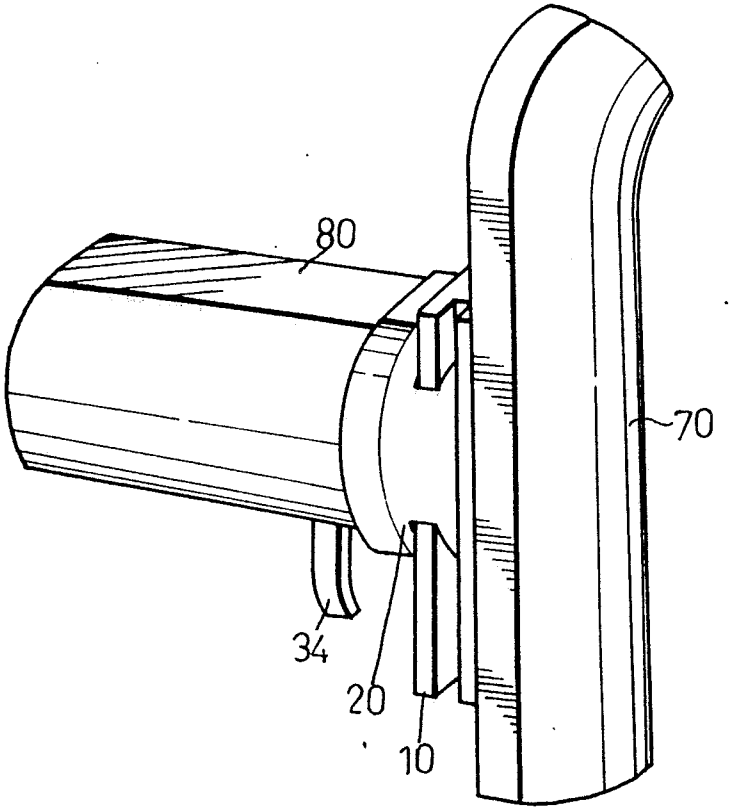
FIG. 5 is an enlarged view of a portion of the baby crib shown in FIG. 4.

Referring to FIGS. 3, 4 and 5, a baby crib comprises a pair of upright support posts 70 and an adjustable fence member 8 with a hollow frame 80. The hollow frame 80 is adjustably attached to the upright support posts 70 by means of a pair of mounting pieces 10 and a pair of slide bodies 20.

Figure 1:
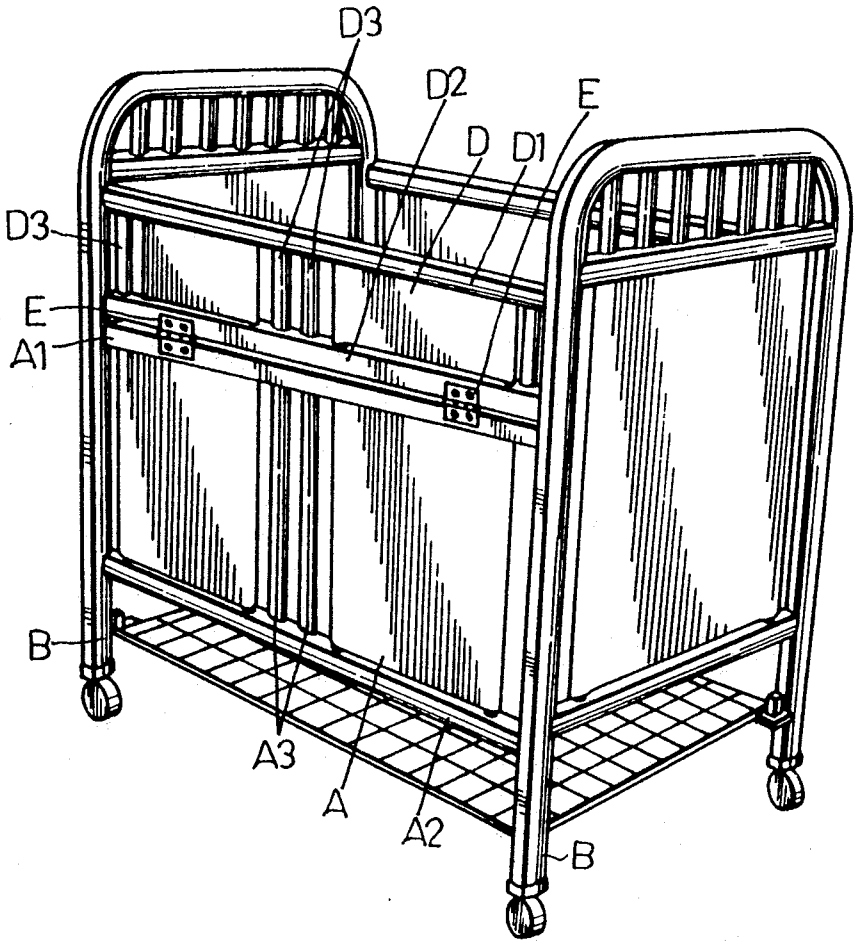
FIG. 1 PRIOR ART
FIG. 1 is an illustration of a conventional baby crib.
Figure 2:
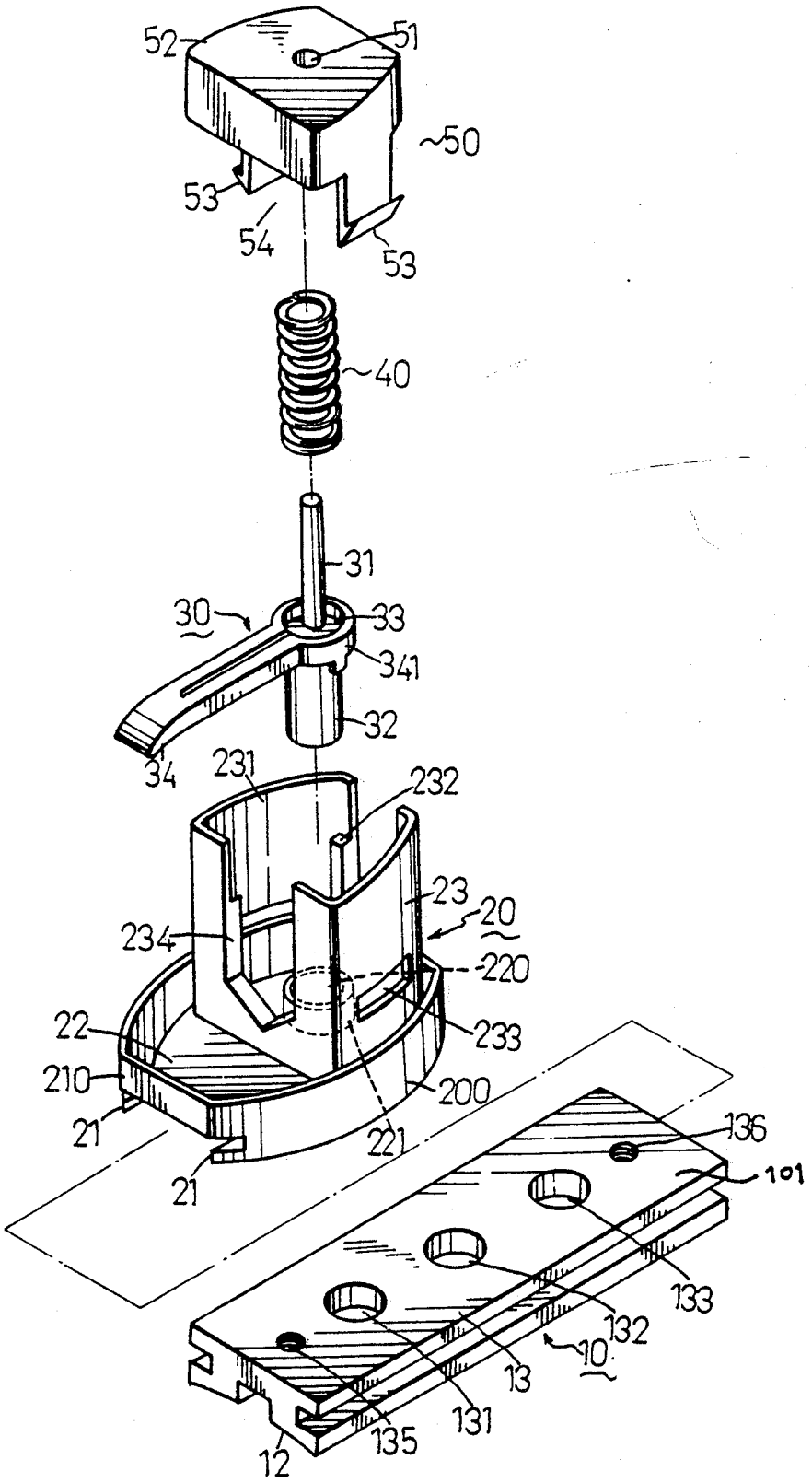
FIG. 2 is an exploded view of an adjusting means for a height adjustable fence of a baby crib according to this invention.

As shown in FIGS. 2 and 3, each of the mounting pieces 10 is formed as an elongated rectangular plate 101. A pair of slide rails 12 extend longitudinally at opposite sides of the rectangular plate 101. The rectangular plate 101 has three spaced engaging circular slots 131, 132 and 133. The rectangular plate 101 further has a pair of through holes 135 and 136 used for fixing the mounting pieces 10 to one of the upright support posts 70 of the baby crib.

Each of the slide bodies 20 comprises a slide portion 200 and a housing portion 23. The slide portion 200 has a base plate 22 with a peripheral wall 210. The bottom face of the base plate 22 slidably abuts the rectangular plate 101. A pair of slide rails 21, said housing portion of each of said slide bodies having a detachably attached cover piece opposite said slide portion, said cover piece having a guide hole, each of said engaging members having a second end opposite said first end which extends through said guide hole formed on the base plate 22 slidably engages the slide rails 12. The base plate 22 has a circular hole 220 having a diameter equal to those of the engaging slots 131, 132 and 133. A cylindrical flange 221 projecting from the base plate 22 surrounds the periphery of the circular hole 220.

The housing portion 23 comprises four walls which project from the base plate 22, forming a housing which is substantially trapezoidal in cross-section, which confines a receiving space 231. The housing portion 23 further includes a plurality of support projections 232 inwardly protruding from the four walls, a pair of oppositely disposed transverse slots 233, and an axial guide opening 234 formed on one of the walls adjacent the transverse slots 233.

Each of the slide bodies 20 has an engaging member 30 which comprises a first cylindrical body 32 with a second restricted cylindrical body 31. A handle piece 34 has a ring shaped end 341 connected to the first cylindrical body 32. The ring shaped end 341 confines a bearing seat 33 for one of the biasing means 40. One end of the first cylindrical body 32 extends inside the cylindrical flange 221 and the circular hole 220 and is selectively inserted in one of the engaging slots 131, 132 and 133. The handle piece 34 projects laterally from the first cylindrical body 32 out of the housing portion 23 through the axial guide opening 234. A biasing means 40 surrounds the second cylindrical body 31 and has one end seated at the bearing seat 33.

Each of the slide bodies 20 has a cover piece 50 which is detachably mounted to one of the housing portions 23 opposite the slide portion 200. The cover piece 50 has a bearing wall 52 formed with a guide hole 51 to allow one end of the second cylindrical body 31 to project therethrough. Another end of the biasing means 40 is in contact with the bearing wall 52. A pair of axial hook members 53 extend on opposite sides of each cover piece 50 to detachably engage the transverse slots 233 of the slide body 20. The support projections 232 of the slide body 20 abut the bottom edges 54 of the cover piece 50, supporting it in this position.

As shown in FIG. 3, the mounting piece 10 is fixed to an upright support post 70 of the baby crib by a pair of screws 60 passing through the through holes 135 and 136. The housing portion 23 of each slide body 20 is inserted in one end of the hollow frame 80 of the fence member 8. The handle piece 34 extends outward through a notch 81 formed at each end of the hollow frame 80. One end of the first cylindrical body 32 projects through the engaging slot 132 of the mounting piece 10. The biasing means 40 urges the first cylindrical body 32 to remain in this position.

When it is desired to adjust the height of the fence member 8 on the upright support post 70, as shown by the dotted lines in FIG. 3, the handle piece 34 of each of the engaging members 30 is pulled back horizontally from the upright support posts 70, thereby withdrawing the first cylindrical bodies 32 from the engaging slots 132. The hollow frame 80 is then moved up or down selectively to engage the first cylindrical bodies 32 and one of the other engaging slots 131 or 133. When the first cylindrical bodies 32 are aligned with the chosen engaging slot 131 or 133, the biasing means 40 urge the first cylindrical bodies 32 to be inserted into the selected engaging slot 131 or 133, thus maintaining the fence member 8 in its new position.

Referring once more to FIG. 4, the number of engaging slots should not be limited to three, as described in the preceding paragraphs. It may be increased to allow greater variations in height.

The main features of the preferred embodiment are as follows:

1. The construction of the preferred embodiment is easy to install and to operate.

2. The preferred embodiment is convenient to use and is safe.

3. The preferred embodiment can be adjusted to different heights according to the user's needs.

4. Adjustment of the preferred embodiment is done on a single vertical plane, thus reducing the operating space.

While the present invention has been described in connection with what is considered the most practical and preferred embodiment, it is understood that this invention is not limited to the disclosed embodiment, but is intended to cover various arrangements included within the spirit and scope of the broadest interpretation so as to encompass all such modifications and equivalent arrangements.

I claim:

1. A baby crib comprising:

a frame body having a pair of upright support posts;

a fence member extending between said upright support posts and having a hollow frame with two ends;

a pair of mounting pieces mounted to said upright support posts so as to connect said fence member to said upright support posts, each of said mounting pieces having a flat plate member formed with a plurality of spaced engaging slots and a pair of first slide rails;

a pair of slide bodies attached to said two ends of said hollow frame, each of said slide bodies having a slide portion slidably abutting one of said mounting pieces, said slide portion of each of said slide bodies having a through hole to be selectively aligned with one of said engaging slots and a pair of second slide rails comprising grooves slidably engaging said first slide rails, each of said slide bodies including a housing portion projecting from said slide portion into one of said two ends of said hollow frame, said housing portion of each of said slide bodies having a detachably attached cover piece opposite said slide portion, said cover piece having a guide hole, each of said engaging members having a second end opposite said first end which extends through said guide hole;

a pair of engaging members, each of said engaging members being movably mounted inside said housing portion of one of said slide bodies, each of said engaging members having a first end moved through said through hole of said slide portion of one of said slide bodies between an engaging position in which said first end engages one of said engaging slots and a releasing position, and a laterally projecting handle portion extending out of said hollow frame through said housing portion; and a pair of biasing means, each of said biasing means being mounted in said housing portion of one of said slide bodies and urging said first end of said engaging member into said engaging position;

whereby, the height of said fence member relative to said upright support posts can be adjusted by operating said handle portion of each of said engaging members to change the position of said engaging members relative to said mounting pieces.

2. A height adjustable fence as claimed in claim 1, wherein each of said engaging members has a first cylindrical body adjacent said first end and a restricted second cylindrical body adjacent to said second end, each of said biasing means surrounding said restricted second cylindrical body of one of said engaging members and having a first end bearing against said first cylindrical body and a second end in contact with said cover piece.

* * * * *